United States Patent [19]

Steele

[11] 4,206,706

[45] Jun. 10, 1980

[54] JOINING LENGTHS OF DETONATING FUSE-CORD

[75] Inventor: Daniel Steele, Stevenston, Scotland

[73] Assignee: Imperial Chemical Industries Limited, London, England

[21] Appl. No.: 568,135

[22] Filed: Apr. 14, 1975

[30] Foreign Application Priority Data

Apr. 22, 1974 [GB] United Kingdom ..... 17496/74

[51] Int. Cl.[2] ..... C06C 7/00

[52] U.S. Cl. ..... 102/27 R; 86/1 R; 206/497

[58] Field of Search ..... 102/27 R; 86/1 R; 206/497

[56] References Cited

U.S. PATENT DOCUMENTS

| | | | |
|---|---|---|---|
| 825,116 | 7/1906 | Engels | 206/497 X |
| 3,046,711 | 7/1962 | Harrison | 206/497 X |
| 3,331,105 | 7/1967 | Gordon | 206/497 X |
| 3,368,485 | 2/1968 | Klotz | 102/27 R |
| 3,401,632 | 9/1968 | Griffith et al. | 102/24 R |
| 3,611,669 | 10/1971 | Shepherd | 206/497 X |
| 3,638,790 | 2/1972 | Schmid et al. | 206/497 X |
| 3,665,858 | 5/1972 | Travor | 102/27 R |
| 3,698,280 | 10/1972 | Welsh | 86/1 R |
| 3,717,096 | 2/1973 | Ward | 102/28 M |
| 3,734,019 | 5/1973 | Rentz et al. | 102/27 R |
| 3,760,728 | 9/1973 | McKee et al. | 102/24 R |

*Primary Examiner*—Edward A. Miller

*Attorney, Agent, or Firm*—Cushman, Darby & Cushman

[57] ABSTRACT

A method of joining detonating cord lengths by encapsulation of the cord lengths in heat-shrunk synthetic plastics film. The method is useful in splicing detonating cord ends and assembling multi-strand charges.

10 Claims, 3 Drawing Figures

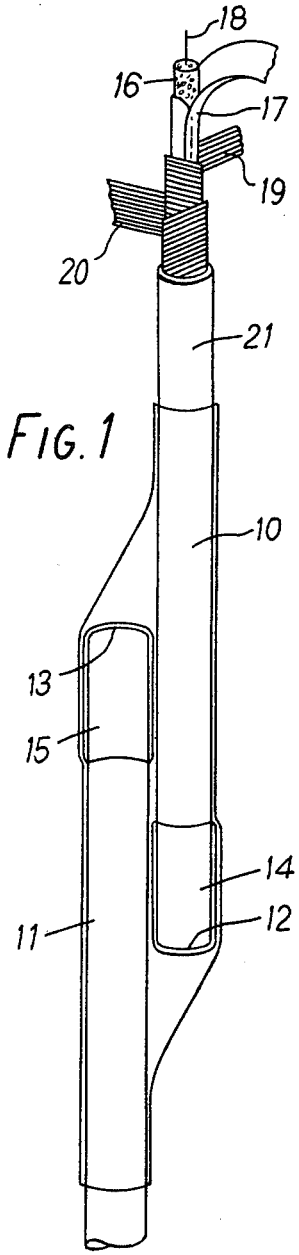
FIG. 1
FIG. 2
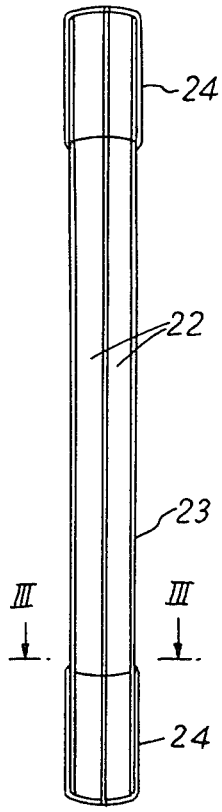
FIG. 3
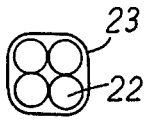

JOINING LENGTHS OF DETONATING FUSE-CORD

This invention relates to a method of joining detonating fuse-cord, and to explosive assemblies of detonating fuse-cord.

Detonating fuse-cord comprising a core of high explosive material such as pentaerythritol tetranitrate surrounded by reinforcing and waterproofing layers of wrapping materials, is widely used in blasting charges and detonation transmission lines. Often during the manufacture and use of the cord, it is necessary to join lengths of detonating cord together by splicing the ends, and lengths of detonating cord are also often bound together to form multi-strand elongated explosive charges for blasting charge priming and rock presplitting. The lengths of cord are bound by adhesive tape wound around the contacting lengths. This method of joining detonating cord is not entirely satisfactory as splices tend to be weak and to break when exposed to water, and helical taping of long charges is slow, costly and generally difficult.

It is an object of this invention to provide a more convenient and improved method of joining lengths of detonating cord.

In accordance with this invention a method of joining two or more lengths of detonating fuse-cord comprises assembling the said lengths in contact, surrounding the contacting lengths with a heat-shrinkable sleeve of synthetic plastics film, and heating the sleeve to cause it to shrink and bind the lengths of fuse-cord together. From another aspect the invention consists in an assembly of two or more lengths of detonating fuse-cord bound together by heat-shrunk synthetic plastics film.

The invention is especially advantageous in splicing together the ends of separate lengths of detonating fuse-cords. Thus a method of splicing together two ends of detonating fuse-cord comprises placing the end portions in parallel contact within a sleeve of heat-shrinkable synthetic plastics film and heating the film to cause it to shrink and bind together the ends of the fuse-cord. To obtain a fully waterproof splice, the explosive cores at the ends to be joined should be covered with waterproof closures, preferably in the form of waterproof caps over the ends of the fuse. These caps are advantageously provides as heat-shrunk caps of synthetic plastics film by placing loose fitting caps of heat-shrinkable synthetic plastics film over the ends of the fuse-cord and heating the caps to shrink them tightly around the ends. The shrinking of the end caps and the splicing sleeve may, if desired, be done simultaneously.

The invention also includes a length of detonating fuse-cord containing a splice wherein overlapping parallel portions of a detonating cord are bound together by heat-shrunk synthetic plastics film.

The invention is further advantageous in the preparation of elongated high explosive charges comprising two or more strands of detonating fuse-cord. Thus the invention also includes a method of preparing a multi-core elongated explosive charge in which method two or more parallel lengths of detonating cord are placed in contact within a loose fitting sleeve of heat-shrinkable synthetic plastics film, and the film is heated to cause it to shrink and bind the lengths of detonating cord tightly together. Also within the scope of the invention is an elongated explosive charge comprising two or more parallel strands of detonating fuse-cord encapsulated within a heat-shrunk casing of synthetic plastics film.

The heat-shrinkable synthetic plastics film preferably comprises polyethylene, polypropylene, polyvinyl chloride or a copolymer of two or more thereof, of a copolymer of ethylene and vinyl acetate.

Preferably the film is such that it shrinks substantially at 140° C. as a PETN core cannot be affected by a heating medium which does not exceed this temperature. In some cases films having lower shrink temperatures will be preferred, for example films shrinkable at 100° C. can be advantageously shrunk by immersion in hot water. In general, however, the higher the shrink temperature used for any given film the stronger is the bond produced. The film may be shrunk by any heating medium, for example hot gas or hot liquid, the latter being more controllable and generally preferred. Suitable liquids include water, mineral oil and silicone oil.

To illustrate the invention further, the construction of assemblies of detonating fuse-cord comprising two or more lengths of fuse-cord joined by the method of the invention is hereinafter described, by way of example only, with reference to the accompanying drawings wherein FIG. 1 shows diagrammatically a side view of two lengths of detonating fuse-cord joined by end-splicing, one length of fuse-cord being partially dissected, FIG. 2 shows diagrammatically a side view of a multi-strand assembly of detonating fuse-cord, and FIG. 3 is a cross-section on the line III—III of FIG. 2.

In the spliced assembly of FIG. 1 two lengths of detonating cord 10 and 11 are cut transversely at the end portions 12 and 13 respectively and the end portions are capped with heat-shrunk plastics end caps 14 and 15. The detonating cord comprises a central core 16 of dry compacted explosive particles which is enclosed within a tubular envelope 17 formed from convoluted tape and has a centre yarn 18, the tape and yarn being present to facilitate formation of the core by passing the explosive through a die in the manufacturing operation. The envelope 17 is surrounded by a helically spun layer of textile yarn 19 and a counterspun layer of textile yarn 20 and the layer 20 is coated with an extruded layer 21 of thermoplastics material.

The ends 12 and 13 are overlapped within a tubular envelope of heat-shrunk plastics material which binds the ends firmly together so that in normal use detonation in one of the lengths of cord will propagate reliably to the other length without interruption.

The practice invention is further illustrated by the following Examples, of which Examples 1 to 5 were constructions as shown in FIG. 1 and Example 6 was a charge as shown in FIGS. 2 and 3.

EXAMPLE 1

One end of each of two lengths of "Cordtex" (Registered Trade Mark) detonating fuse-cord having an outside diameter of 6 mm were capped with heat-shrinkable polyvinyl chloride caps 3 cm long, and 0.07 mm thick and dipped for 5 seconds in water at 90° C. to shrink the caps around the ends and form a waterproof closure over the ends of the explosive cores of the cord lengths. The capped ends were placed within a heat-shrinkable polyvinyl chloride sleeve 15 cm long, 15 mm diameter and 0.07 mm thick and overlapped for 15 cm, i.e. over the sleeve length. The overlapped sleeve ends were immersed for 5 seconds in water at 90° C. to shrink the polyethylene sleeve, and the ends were firmly bound together by the heat-shrunk sleeve. The splice withstood an axial pull of 60 pounds and there was no water penetration into the fuse-cord when the splice was immersed in water for 17 hour sat a pressure of 10 psi.

EXAMPLE 2

Two end lengths of "Cordtex" detonating fuse-cord having an outside diameter of 7.6 mm were spliced together as in Example 1 except that the heat-shrinkable polyvinyl chloride sleeve and end caps were heat-shrunk by immersion in silicone oil at 120° C. The splice obtained withstood an axial pull of 140 pounds and there was no water penetration into the core of the fuse-cord when the splice was immersed in water for 17 hours at a pressure of 30 psi.

EXAMPLE 3

Two end lengths of "Cordtex" detonating fuse-cord were spliced together as described in Example 1 except that the heat-shrinkable sleeve and heat-shrinkable end caps were polyethylene which was heat-shrunk by immersion in a bath of silicone oil at 130° C. The splice obtained withstood an axial pull of 150 pounds and there was no water penetration into the core of the fuse-cord when the splice was immersed in water for 17 hours at a pressure of 30 psi.

EXAMPLE 4

Two ends of "Cordtex" detonating fuse-cord were spliced together as described in Example 1 except that the heat-shrinkable sleeve and the heat-shrinkable caps were polypropylene, which was shrunk by heating with hot air at 140° C. The splice obtained withstood an axial pull of 150 pounds and there was no water penetration into the core of the fuse-cord when the splice was immersed in water for 17 hours at 30 psi.

EXAMPLE 5

Two ends of "Cordtex" detonating fuse-cord were spliced together as described in Example 1 except that the heat-shrinkable sleeve and end caps were made of an 82/18 (by weight) copolymer of ethylene and vinyl acetate, which was shrunk by immersion in a bath of silicone oil at 140° C. The splice obtained withstood an axial pull of 150 pounds and there was no water penetration into the core of the fuse-cord when the splice was immersed in water for 17 hours at 30 psi.

EXAMPLE 6

In the assembly shown in FIGS. 2 and 3, four strands of detonating fuse-cord 22 are enclosed in a tight fitting envelope 23 of heat-shrunk plastics film as illustrated in FIGS. 2 and 3 and the ends of the multi-strand charge are sealed with end caps 24 of heat shrunk plastics film.

Four, 15 meter lengths of "Cordtex" detonating fuse-cord, each having an outside diameter of 7.6 mm and containing a core charge of 40 grams PETN per meter were disposed side by side inside a tubular heat-shrinkable polyvinyl chloride sleeve 16 meters long, 20 mm diameter and 0.07 mm thick. The sleeve was cut longer than the fuse-cord lengths to compensate for some expected axial shrinkage. The sleeved fuse-cord was immersed for 5 seconds in water at 90° C. and the sleeve contracted and bound the fuse-cord lengths tightly together. The excess polyvinyl chloride was trimmed from the ends of the composite charge and the ends were covered with loose fitting heat-shrinkable polyvinyl chloride end caps which were shrunk by dipping in water at 90° C. The resultant multi-strand charge was sufficiently rigid for insertion into a 15 meter long drill-hole, yet was sufficiently flexible to be easily coiled into 40 cm diameter coils for packing and transport.

In a rock pre-splitting operation in excavating a roadway cutting through limestone, elongated charges of this Example were successfully used in 10 cm diameter, 15 meter deep holes drilled at 1 meter spacing in the intended cracking plane in the rock.

What we claim is:

1. A method of joining two or more lengths of flexible detonating fuse-cord having an explosive core enclosed within a yieldable water-proof envelope, said method comprising placing the ends of the lengths in parallel contact, surrounding the contacting lengths with a heat-shrinkable sleeve of synthetic plastics film, and heating the sleeve to cause it to shrink and bind the lengths of fuse-cord together.

2. A method as claimed in claim 1 wherein the explosive core at least at one of the ends of the fuse-cord is covered with a waterproof closure comprising a heat-shrunk end cap of synthetic plastics film.

3. A method as claimed in claim 2 wherein the heat-shrinking of the end cap and of the splicing sleeve is effected simultaneously.

4. A method as claimed in claim 1 wherein the heat-shrinkable film is selected from the group consisting of polyethylene, polypropylene, polyvinyl chloride, copolymers of any two or more thereof, and copolymers of ethylene and vinyl acetate.

5. A method as claimed in claim 1 wherein the film is shrunk by heating with a heating medium selected from the group consisting of hot gas and hot liquid.

6. A method as claimed in claim 5 wherein the film is shrunk by means of a heating medium selected from the group consisting of hot water, mineral oil and silicone oil.

7. An assembly of two or more lengths of detonating fuse-cord having an explosive core enclosed within a yieldable water-proof envelope, said lengths being in parallel contact and being bound together by heat-shrunk synthetic plastics film.

8. A length of detonating fuse-cord having an explosive core enclosed within a yieldable water-proof envelope, said length containing a splice wherein overlapping parallel portions of a detonating cord are bound together by heat-shrunk synthetic plastics film.

9. An elongated explosive charge comprising two or more parallel strands of detonating fuse-cord having an explosive core enclosed within a yieldable water-proof envelope, said strands being in parallel contact and being encapsulated within a heat-shrunk casing of synthetic plastics film.

10. An assembly as claimed in claim 7 wherein the synthetic plastics film is selected from the group consisting of polyethylene, polypropylene, polyvinyl chloride, copolymers of any two or more thereof, and copolymers of ethylene and vinyl acetate.

* * * * *